United States Patent [19]

Millhimes et al.

[11] Patent Number: 4,593,960

[45] Date of Patent: Jun. 10, 1986

[54] POWER ENTRY CONNECTOR

[75] Inventors: Wayne L. Millhimes, Hershey; Daniel J. Murren, Dillsburg, both of Pa.

[73] Assignee: AMP Incorporated, Harrisburg, Pa.

[21] Appl. No.: 716,715

[22] Filed: Mar. 27, 1985

[51] Int. Cl.[4] ..... H01R 13/44

[52] U.S. Cl. ..... 339/42; 339/34

[58] Field of Search ..... 339/42, 31 R, 31 M, 339/122, 32 R, 34

[56] References Cited

U.S. PATENT DOCUMENTS 3,909,566 9/1975 Morrison et al. ..... 339/34

3,926,494 12/1975 Maillaro ..... 339/34

4,445,739 5/1984 Wooten ..... 339/42

*Primary Examiner*—Gil Weidenfeld

*Assistant Examiner*—Paula A. Austin

*Attorney, Agent, or Firm*—Allan B. Osborne

[57] ABSTRACT

A power entry connector for bringing power to an electrical distribution system mounted in modular wall panels. The power entry connector includes a housing and means in the housing to retain contacts having tabs extending outwardly from the housing, and a spring mounted cover on the housing to cover the tabs in a non-operational state and to be slidably moved to expose the tabs in an operational state.

9 Claims, 8 Drawing Figures

64
60
28
62
94
72
58
70
88
134
32
138
142
40
40
176
36
38
38
108
104-S
30
34
162
168
154
160
120
118
116
104-L

POWER ENTRY CONNECTOR

This invention is related to electrical connectors and more particularly to an electrical connector for supplying electrical power to an electrical junction box.

U.S. Pat. No. 4,278,834 discloses a power distribution system for modular wall panels. Terminal boxes at each end of a raceway in each wall panel include recesses to receive removable receptacles into which conventional electrical male plugs may be inserted. Power is supplied to the system either from a junction box in the ceiling or from a junction box in the floor. In the latter case, the wires, enclosed in an armored cable, leading from the junction box are terminated in a female connector head having a separate shrouded receptacle for each wire. This unit plugs into a male electrical connector on an end of the terminal box within the raceway. Thus, to power or de-energize the system, cover plates on the wall panel must be removed and reattached. Further, separate openings must be provided for the power cable in the cover plates or elsewhere.

It is an object of the present invention to provide a power entry connector which is removably received in a receptacle-receiving recess in a power junction box mounted in a modular wall panel.

Accordingly, a power entry connector constructed in accordance with the present invention comprises a housing formed with side, end and back walls which define a cavity with an opening thereto being opposite the back wall and further a wire receiving passage into the cavity through one of the walls, contact retaining means for retaining a plurality of contacts having tabs on one end and wire receiving means on another end, said contact retaining means being positioned in the cavity such that tabs on contacts which may be retained will extend out through the opening and the wire receiving means will be near the passage to receive wires which may be inserted into the cavity through the passage and a cover formed with side, end and front walls which define a cavity with an opening thereto being opposite the front wall, and further, a plurality of slits through the front wall, said cover being telescopingly and slidably mounted onto the housing so as to cover the opening to the cavity therein and, when in a first location, to cover tabs which may be extending through the opening, but when in a second location further onto the housing, said tabs will extend through the slits.

For a better understanding of the invention, reference will now be made by way of example to the accompanying drawings, in which.

Figure 1:
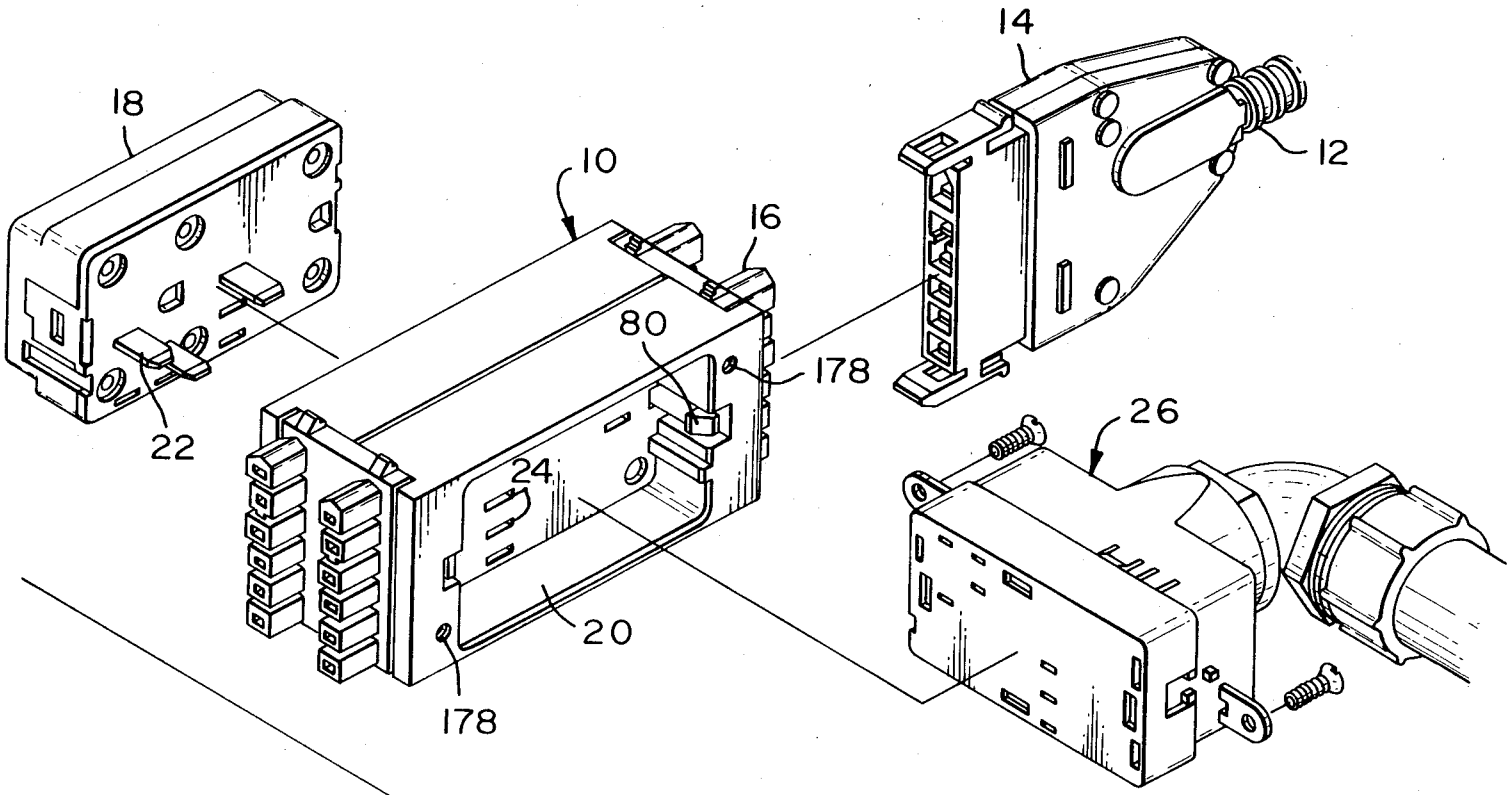
FIG. 1 is an isometric view of a power junction box, a duplex receptacle for plugging into the junction box, a female power connector, and a power entry connector, the latter being constructed in accordance with the concept of the present invention.
Figure 2:
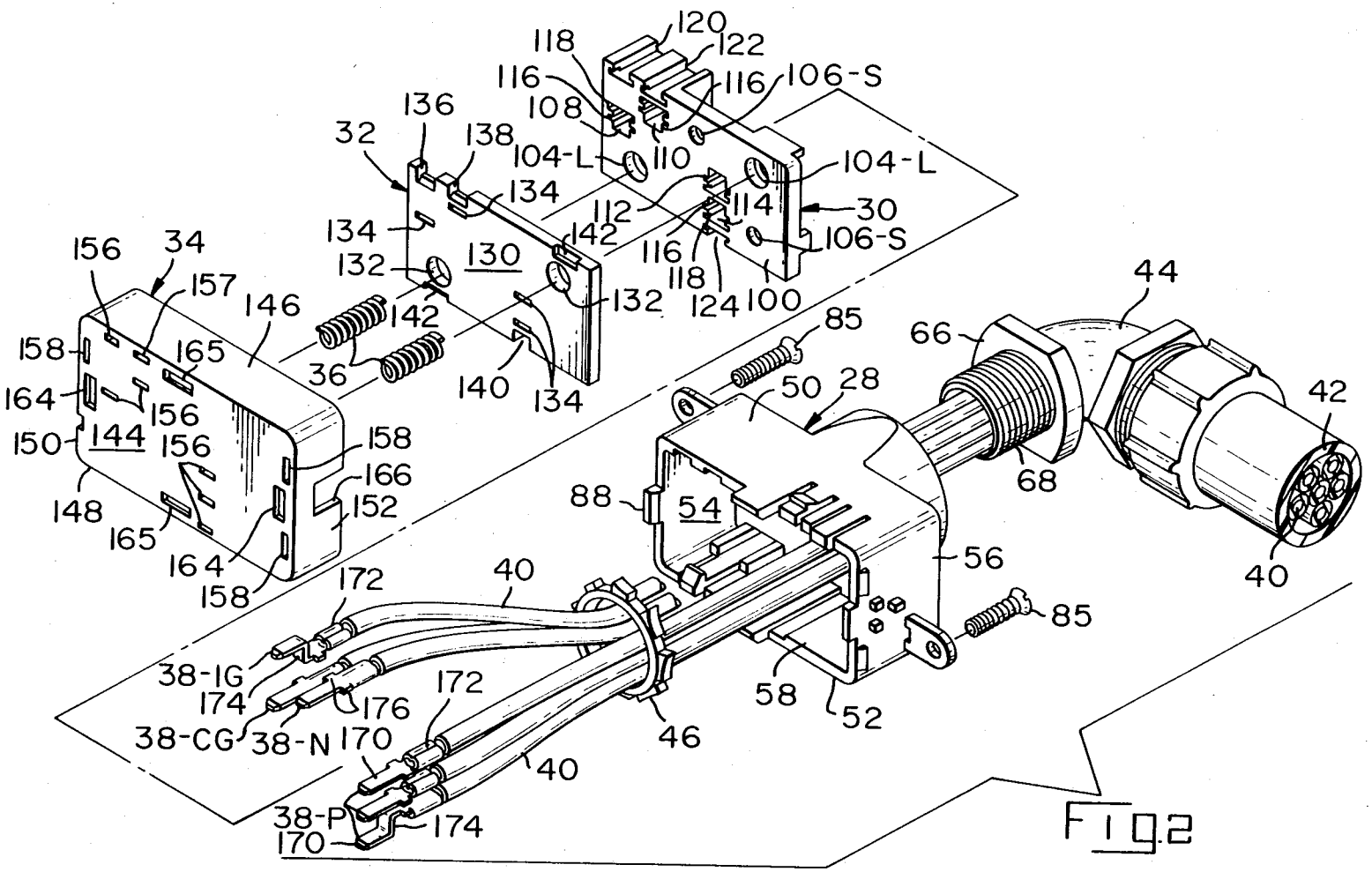
FIG. 2 is an exploded isometric view of the components that form the power entry connector.
Figures 2A, 7:
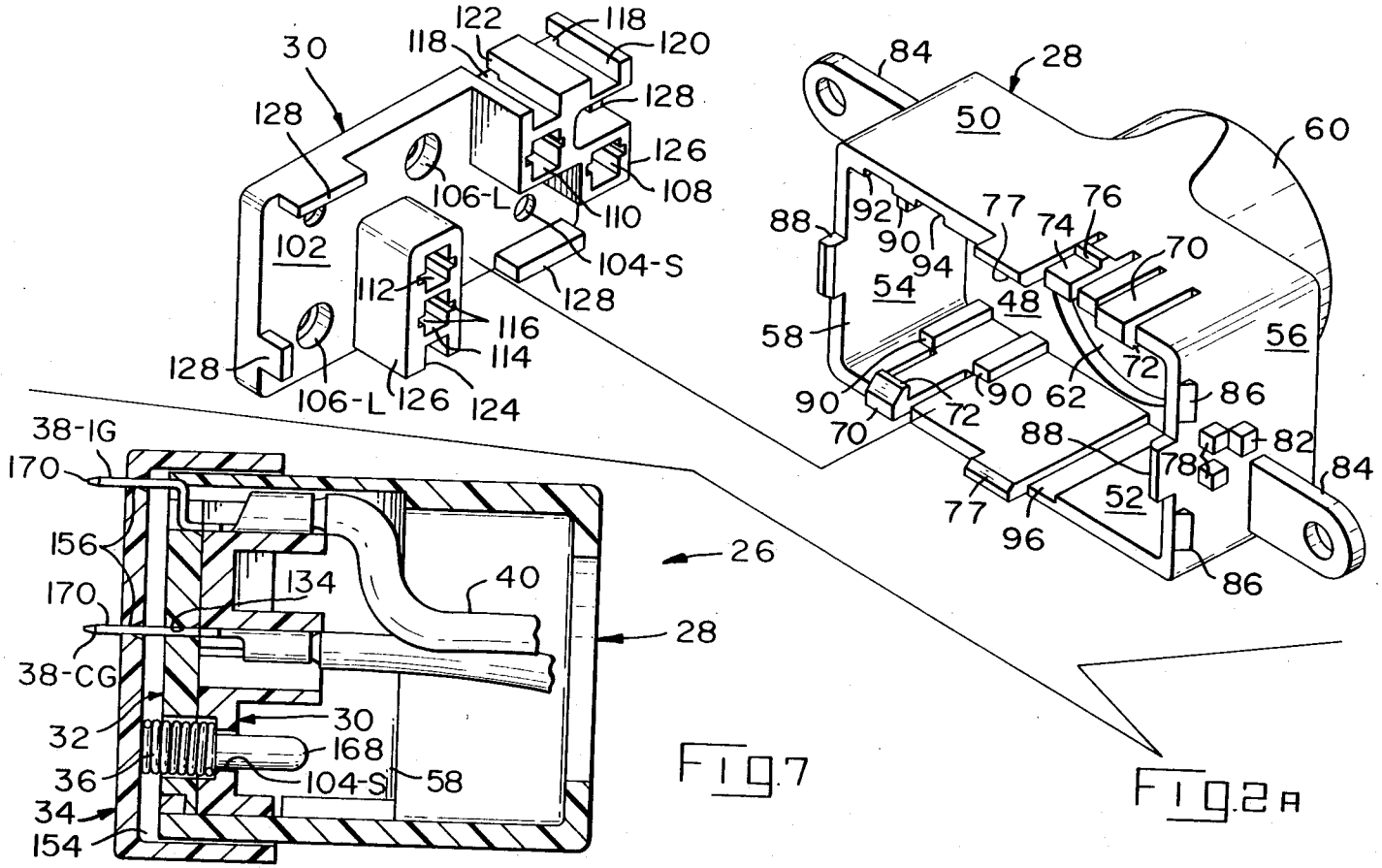
Figure 3:
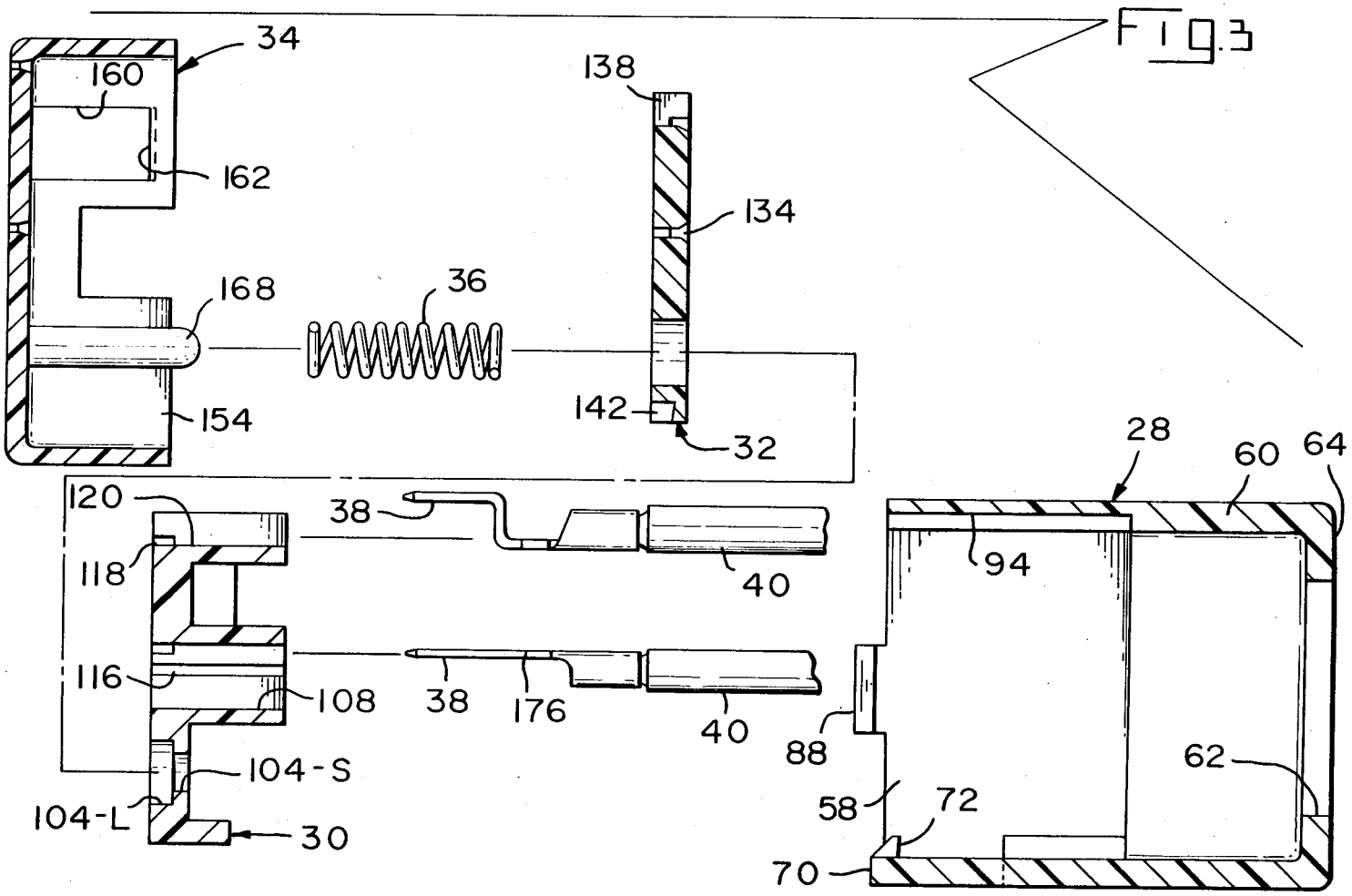
Figure 4:
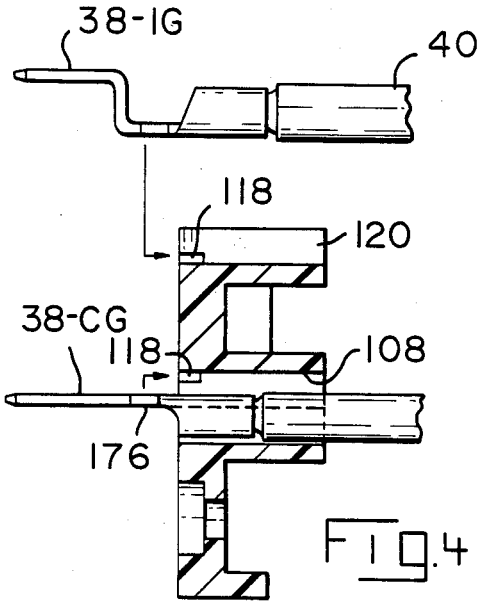
Figure 5:
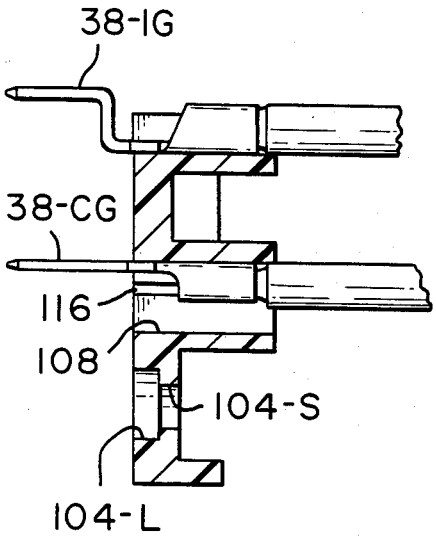
Figure 6:
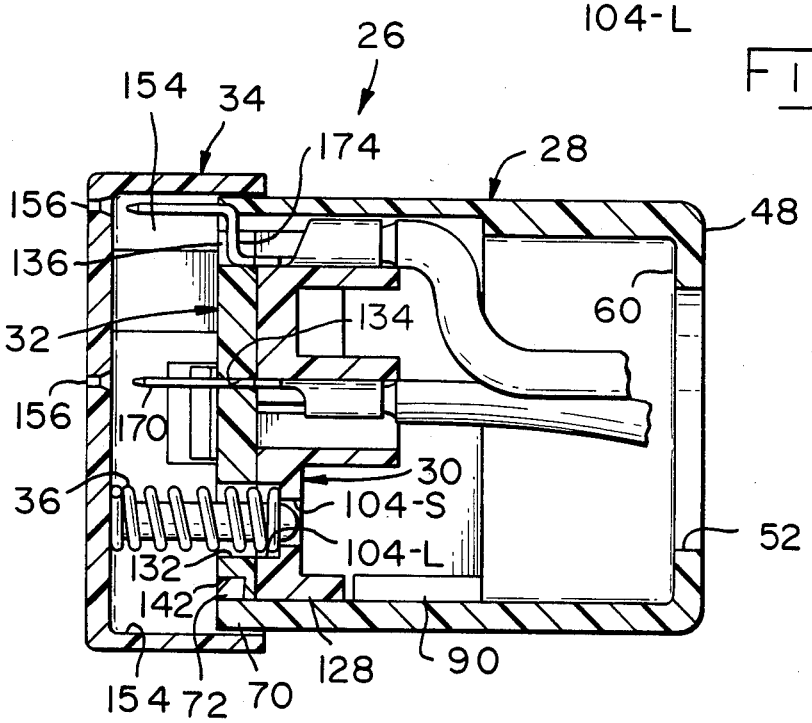

FIG. 2-*a* is an enlarged drawing of two components of the power entry connector;

FIG. 3 is a cross sectional view of the several components of the power entry connector arranged in order of assembly;

FIGS. 4 and 5 are cross-sectional views of one of the contact plates of the power entry connector showing the placement of contacts therein;

FIG. 6 is a cross-sectional view of an assembled power entry connector in a non-operating or non-functional state; and FIG. 7 is a cross-sectional view of the assembled power entry connector as it would be if plugged into a recess in the power junction box of FIG. 1.

With reference to FIG. 1, reference numeral 10 indicates a power junction box which is the major part of an electrical distribution system located along raceways adjacent to the lower edge of modular wall panels (not shown). As is known, each wall panel may have a number of such boxes, connected together by electrical wires encased in a flexible armored casing 12 and terminated in female power connectors such as the one shown in the drawing and indicated by reference numeral 14. The female power connectors plug onto outwardly extending shrouds 16 in which are mating ends of buss bars (not shown) located in the power junction boxes. Duplex receptacles, such as the one shown in the drawing and indicated by reference numeral 18, plug into recesses 20 located on each side of a box 10. The receptacles are energized by tabs 22 thereon entering into the box through slots 24 and engaging sockets on the buss bars.

The electrical system is powered by current coming from a floor mounted monument or tombstone (not shown) and entering the system through power entry connector 26 constructed in accordance with the concepts of the present invention. The use of power entry connector 26 permits energizing or de-energizing an electrical distribution system in modular wall panels by very simply plugging into or withdrawing the connector from a recess 20 in any given box 10.

The power entry connector of the present invention is shown disassembled in FIG. 2 to which reference will now be made.

The several components of the power entry connector include housing 28, back plate 30, front plate 32, cover 34, springs 36 and contacts 38. The wires, indicated by reference numeral 40, cable 42, cable conduit 44 and lock ring 46, all of which are associated with the power connector, are commercially available items and are not part of the present invention.

The housing 28, plates 30, 32 and cover 34 are preferably molded with the material being a carbonate-linked polymer sold under the trademark "LEXAN" by the General Electric Company.

FIG. 2-*a* is an enlarged view of the housing and plate 30. With reference thereto and to FIG. 3, a description of the housing follows:

The housing includes a back wall 48, side walls 50, 52 and end walls 54, 56. These walls define front opening cavity 58.

A hollow boss 60 is attached to and extends rearwardly from back wall 48. A passage 62 (FIG. 3) through the boss provides access to cavity 58 for wires 40. Rearwardly facing surface 64 on the boss receives flange 66 on conduit 44 (FIG. 2). Threaded stud 68 on the conduit extends through passage 62 and receives lock ring 46 to secure the conduit 44 to the housing in a known manner.

With regard to the side walls 50 and 52, a latch 70 is provided on each one. These latches are hinged at one end and are resiliently movable in an arc perpendicular to the plane of the side walls. Each latch includes a hook 72 facing into cavity 58. Note that one latch is adjacent end wall 56 and the other latch on the opposite wall is near the opposing end wall 54.

Safety stop member 74 is carried on side wall 50 alongside the latch 70 and includes a forwardly facing shoulder 76. This member is resiliently hinged to the side wall as are latches 70 and accordingly can be moved over a short distance. Further, a stability finger 77 is located on the free edges of top wall 50 and bottom wall 52.

Two blocks 78, positioned on each end wall 54, 56, provide shoulders to receive latches 80 located in recesses 20 on the power junction boxes (FIG. 1). A third block, indicated by reference numeral 82, provides a fulcrum for a tool (not shown) used to release latch 80. An ear 84 is also positioned on each end wall. The holes through the ears receive screws 85 (FIG. 2) to more securely attach power entry connector 26 to power junction box 10.

End wall 56 carries a pair of retaining means 86 which are located right adjacent the free edge of the wall and which bracket a finger 88 projecting forwardly from that free edge. End wall 54 carries a single retaining means 86 (not shown) located adjacent the free edge and just above finger 88 located on the edge of that wall.

Stop means 90 are provided on the inside surfaces of each side and end wall. Additionally a pair of parallel channels 92, 94 are cut into the inside surface of side wall 50 and a single channel 96 is cut into the inside surface of side wall 52.

The front face 100 of back plate 30 is shown in FIG. 2. Cross-sectional views are shown in large detail in FIGS. 4 and 5 and the back face 102 is shown in FIG. 2-*a*.

With reference to FIG. 2, it can be seen that a number of openings extend through the plate. Two such openings indicated by reference numeral 104, are counterbored to provide a large spring receiving section 104-L opening out onto the front face and a smaller, pin receiving section 104-S (seen clearly in FIG. 5) opening out onto the back face. These two openings are located near diagonally-opposite corners of the plate.

A second set of two openings, indicated by reference numeral 106, are also counterbored to provide a small diameter section 106-S opening out onto front face 100 and a larger diameter section 106-L opening out onto back face 102 (FIG. 2-*a*).

There are two contact passages 108 and 110 on one side of the plate. These two passages are displaced both vertically and horizontally relative to each other. There are an additional two contact passages 112 and 114 located towards the other side of the plate. These two passages are positioned one over the other. Each of the four passages have slot sets along two opposing walls. Each set comprises two slots on the same plane and with each slot being in an opposing wall. One set, identified by reference numeral 116, extends through the passage and can be seen clearly in FIGS. 2-*a* and 5. The second set, indicated by reference numeral 118 in FIG. 4, extends a short distance back into the passage from the plate's front face. The slots are also seen in FIG. 2 with the short or second slots 118 being above the first set of slots 116 in passages 108, 110 and below the first set of passages 112, 114.

In addition to the contact passages, there are two contact channels 120 and 122 on the upper edge of the plate as seen in FIG. 2 and one contact channel 124 on the bottom edge directly below passages 112, 114. Both of these channels include a second or short set of slots (FIG. 4). When plate 30 is positioned within housing 28, these channels cooperate with channels 92, 94 and 96 to form contact passages.

The back face 102 of plate 30 is shown in FIG. 2-*a*. Rearwardly projecting walls, indicated by reference numeral 126, define and extend the length of the several passages and channels beyond the back face. Rearwardly projecting bars 128 are located around the periphery of the plate so as to meet stop means 90 when the plate 30 is positioned within housing 28.

The front face 130 of front plate 32 is shown in FIG. 2 and side sectional views are shown in FIGS. 3, 6 and 7. With reference to FIG. 2 primarily, a pair of openings 132, located near diagonally opposite corners, extend through the plate. Four slits 134 extend through the plate and further, are positioned to be in line with slots 118 in the several passages in plate 30 when the two plates are positioned together in housing 28. Similarly, a pair of notches 136, 138 are provided in one edge of the plate near one corner and a single notch 140 is provided in the opposite edge of the plate near a diagonally opposite corner. These notches are in line with channels 120, 122 and 124 respectively in plate 30 when the two plates are positioned together. A recess 142 is also provided in each of the two elongated edges of the plate.

The aforementioned openings, slits and notches open out onto the back face. Also a pair of rearwardly projecting snap pins (not shown) are located on the back face.

The two plates, 30 and 32, form contact retaining means. It will be obvious, however, that one plate could be modified so as to obviate the need for the other plate.

Cover 34 is shown isometrically in FIGS. 1 and 2 and sectionally in FIGS. 3, 6 and 7. With reference to FIG. 2 primarily, cover 34 includes front wall 144, side walls 146 and 148 and end walls 150 and 152. These five walls define a rearwardly opening cavity 154 which is shown in FIGS. 3, 6 and 7.

A series of six slits 156 extend through the front wall and into cavity 154. Thess slits are in registration with slits 134 and notches 136, 140 when the power entry connector is assembled. A seventh slit 157, adjacent a slit 156 and located next to sidewall 146, is in registration with notch 138 and channel 122.

On one end of the cover a pair of slits 158 are provided and similarly a third slit 158 is provided on the opposite end. These slits are core pin access openings for the purpose of providing grooves 160 along the inside surfaces of the end walls and a forwardly facing shoulder 162. One such groove and shoulder can be seen in FIG. 3.

Two additional slits 164 of somewhat greater width are also provided in the front wall near slits 158. These slits receive fingers 88 on housing 28 when the connector is assembled and plugged into recess 20 in a box 10. Similarly, slits 165 are provided in the front wall adjacent side walls 146, 148 to receive stabilizing fingers 77.

A cutout, indicated by reference numeral 166, is provided in each end wall 150, 152.

Structures within cavity 154 include the aforementioned grooves 160 and shoulders 162. In addition, a pair of rearwardly projecting pins 168 are provided on the inside surface of front wall 144. The cross-sectional views of the cover show one such pin. These pins are spaced to extend through openings 132 in plate 32 and openings 104 in plate 30 when the connector is assembled.

Contacts 38 are stamped and formed from a conductive material. Each contact has a tab 170 on one end and a crimpable wire barrel 172 (or other wire receiving means) on the other end as seen in FIG. 2. Three contacts, indicated by the letter "P" following reference numeral 38, are crimped to hot or power wires. The tab on one of these contacts is displaced or offset relative to the wire barrel with the offspring strap being indicated by reference numeral 174. A fourth contact is attached to a neutral wire and is indicated by the letter "N". A fifth contact is attached to a common ground and is indicated by the reference numeral 38 plus the letters "CG". The sixth contact is attached to an isolated ground wire and accordingly is indicated by the letters "IG" following the numeral 38. The tab on this contact is also offset relative to the wire barrel with the offsetting strap being indicated by reference numeral 174.

Further, each contact includes a pair of laterally projecting ears 176 just forward of the wire barrel 172.

The assembly of power entry connector 26 is generally indicated in FIGS. 2 and 3. It begins with placing threaded stud 68 into cavity 58 and securing conduit connector 44 to housing 28 with lock ring 46 threaded onto the stud. The next step is to crimp contacts 38 onto wires 40 and threading the contacts/wires through the conduit connector and housing 28.

The contacts are now threaded through the appropriate passages and channels in plate 30. The neutral and ground contacts 38-CG, 38-N (both having straight tabs) are passed through passages 108 and 110 with ears 176 passing through in slots 116. After the ears clear the passages, as shown in FIG. 4, the contacts are backed up but with ears 176 now in slots 118. This properly positions contacts 38-CG, 38-N in the passages as shown in FIG. 5. (Contact 38-N is not shown in FIGS. 4 and 5).

Similarly, power contacts 38-P with straight tabs are positioned in the same manner in passages 112 and 114.

The two contacts having offset tabs, one 38-P and isolated ground 38-IG are positioned in channels 124 and 120 respectively. As indicated in FIGS. 4 and 5, these contacts are simply dropped into the channels and pulled rearwardly with ears 176 entering slots 118.

With contacts 38-P (all three), 38-CG, 38-N, 38-IG loaded into plate 30, the back face of plate 32 is abutted against front face 100 of plate 30. Snap pins on plate 32 are forced through openings 106 to create a sub-assembly to temporarily retain the contacts between the plates. Alternately, an adhesive could be used between the abutting faces. Still another alternative would be not to permanently or temporarily join them at all.

As shown in FIGS. 6 and 7, tabs 170 pass through slits 134 in plate 32 while straps 174 on those contacts with offset tabs are received in notches 136 (FIG. 6) and 140.

With plates 30 and 32 together, they are positioned into housing 28. The depth of insertion is predetermined by bars 128 on plate 30 abutting stop means 90 within cavity 58. FIGS. 6 and 7 illustrate this positioning. Concurrently, wires 40 are being pulled back through passage 62 so as not to bunch up within cavity 58.

As the two plates are being moved into the cavity, latches 70 are being biased out of the way until plate 32 passes in behind hook 72. The latches snap back to bring the hook in front of plate 32 and more particularly into recesses 142. These latches removably lock the two plates into housing 28 such as shown in FIGS. 6 and 7.

Cover 34 is added to complete the assembly. First coil springs 36 are located on pins 168 (FIG. 6). The side walls 146, 148 and end walls 150, 152 slid over side walls 50, 52 and end walls 54, 56 of housing 28. The end wall 150, 152 bow out slightly in passing over retaining means 86 until the means enter grooves 160. The retaining means, in cooperation with shoulders 162 defined by the grooves, removably retain the cover on housing as shown in FIGS. 1, 6 and 7. The cover can be moved back and forth on the housing for the length of the aforementioned grooves.

Pins 168 slid through openings 132 (plate 32) and 104 (plate 30). The coil springs are located in openings 132 and sections 104-L. The forwardly facing shoulder defined by the counterbores in openings 104 and the inside surface of front wall 144 of the cover capture the coil springs therebetween.

The assembled connector, without cable conduit 44 and four of the six wires 40 and associated contacts, is shown sectionally in FIG. 6 in the non-functioning state; i.e., springs 36 are urging cover forwardly away from housing 28 so that tabs 170 are isolated by the cover. This is an absolute requirement in that wires 40 would be connected to a floor mounted monument and would be energized. In this regard, attention is directed to two safety features. This first is stop member 74. The cover abuts shoulder 76 and cannot be moved further rearwardly unless member 74 is depressed. The second safety feature regards cutouts 166. The cutouts provide a recess for blocks 78 as the cover moves back on housing 28. With the cover in its forwardly extended position as shown in FIG, 1, the cutout space would provide an access into cover cavity 154 and contact tabs 170 therein except for the forwardly extending fingers 88. These fingers block such an access. FIG. 1 is an isometric view of an assembled power connector 26 with cable conduit 44 attached thereto.

FIG. 7 is a sectional view similar to FIG. 6. Here, the connector is shown as if plugged into recess 20 in box 10. The connector moves into the recess until the cover encounters the back wall of the recess. At that point, provided stop member 74 is being depressed, the rest of the connector continues to move forward. Tabs 170 pass through slits 156 and into the sockets on the buss bars within the box via slots 24. Coil springs 36 are compressed and the free ends of pins 168 enter cavity 58 of housing 28 via openings 104. When the connector is fully home, latches 80 will be caught on blocks 78 to releasably lock the connector to the box. The connector is then made more secure against inadvertent withdrawing by screwing self-tapping screws 85 into box 10 through holes in ears 84 on the housing. Holes 178 are provided on the box to receive the screws (FIG. 1).

The power entry connector may be released from power junction box 10 by removing the aforementioned screws and prying back latches 80. In this regard a screw driver tip is inserted against the latch, and using block 82 as a fulcrum, the latch is pried off blocks 78.

The contact passage formed by channels 122, 94, along with notch 138 (plate 32) and slit 157 (cover 34) provide means for substituting a dedicated neutral wire 40 for the shown isolated ground wire. The contact for the dedicated neutral would have the same structure as contact 38-IG and would be mounted in plate 30 in the same manner.

We claim:

1. A power entry connector for being plugged into a duplex-receiving recess in an electrical power junction box or the like for the purpose of bringing power thereinto, comprising:

(a) a housing formed with side, end and back walls which define a cavity with an opening thereto being opposite the back wall, a wire-receiving passage into the cavity through one of the walls and further having removable stop means on one of said side walls;

(b) contact retaining means adapted to retain a plurality of contacts of the type having a tab on one end and wire receiving means on another end, said contact retaining means being positionable in the cavity such that tabs on contacts which may be retained will extend out through the opening and the wire receiving means will be near the passage to receive wires which may be inserted into the cavity through the passage;

(c) a cover formed with side, end and front walls which define a cavity with an opening thereto being opposite the front wall, and further, a plurality of slits through the front wall, said cover being telescopingly and slidably mounted onto the housing so as to cover the opening to the cavity therein and, when in a first location, to cover tabs which may be extending through the opening, but when in a second location further onto the housing said tabs will extend through the slits; and (d) means for biasing said cover in said first location.

2. The power entry connector of claim 1 wherein the contact retaining means include a plate having contact receiving passages therein.

3. The power entry connector of claim 2 further including latch means on the side walls of the housing adapted to latch the plate in the cavity.

4. The power entry connector of claim 3 wherein the cover is slidably attached to the housing by retaining means on the end walls of the housing cooperating with grooves and groove defining shoulders in the inside surface of the end walls of the cover.

5. A power entry electrical connector for supplying electrical power from electrical power conductors of an electrical power cable to an electrical junction box, comprising:

an insulated housing with means for securing the electrical power cable thereto and in which the power conductors are disposed;

electrical contacts having terminating sections for electrical connection with respective power conductors and contact sections;

insulated contact retaining means disposed in the insulated housing having positioning and securing means in which the electrical contacts are positioned and secured isolated from each other;

an insulated cover movably mounted on the housing and having openings in alignment with respective contact sections and spring receiving pins;

a plurality of coil springs disposed on said pins for maintaining the cover in a first position covering the contact sections with said cover being movable to a second position when the electrical connector engages the electrical junction box to expose the contact sections through the openings to enable the contact sections to be electrically connected to respective electrical conductive members in the junction box to supply electrical power thereto and latch means on said housing for latchable engagement with the junction box.

6. The power entry electrical connector of claim 5 wherein the insulated contact retaining means includes a first plate having contact receiving passages therein.

7. The power entry electrical connector of claim 5 wherein the electrical contacts include laterally extending ears intermediate the terminating sections and the contact sections and the contact receiving passages in the first plate include slots for receiving the ears on the electrical contacts and preventing withdrawal of the electrical contacts from the passages in one direction.

8. The power entry electrical connector of claim 7 further including a second plate having contact section receiving passages, said second plate being positionable against the first plate to prevent withdrawal of the electrical contacts from the passages in the first plate in another direction.

9. The power entry electrical connector of claim 8 further including removable latching means on the housing for retaining the first and second plates therein.

* * * * *